United States Patent [19]

Reed et al.

[11] 4,449,647

[45] May 22, 1984

[54] HANDLE ASSEMBLY FOR A PRESSURIZED DISPENSING CONTAINER

[75] Inventors: Norman L. Reed; Trevor D. Parkin, both of Kings Lynn, England

[73] Assignee: Bespak Industries Limited, Norfolk, England

[21] Appl. No.: 403,967

[22] Filed: Aug. 2, 1982

[30] Foreign Application Priority Data

Aug. 10, 1981 [GB] United Kingdom ..... 8124415

[51] Int. Cl.[3] ..... B67B 5/00; B67D 5/32

[52] U.S. Cl. ..... 222/153; 222/402.13; 222/402.15; 222/473; 16/110.5; 220/94 R; 403/71

[58] Field of Search ..... 222/153, 323, 402.1, 222/402.11, 402.15, 470, 472, 473, 545, 182, 465, 467, 469, 173, 402.13; 16/110.5, 110 R, 121, 124, DIG. 12, DIG. 18, DIG. 19, DIG. 30; 220/94 R; 403/69, 71; 169/30, 71

[56] References Cited

U.S. PATENT DOCUMENTS 3,158,292 11/1964 O'Donnell ..... 222/182 X 3,506,159 4/1970 Muller ..... 222/402.13 X 3,747,807 7/1973 Gach ..... 222/182 X 4,187,963 2/1980 Mascia ..... 222/402.13

*Primary Examiner*—Joseph J. Rolla

*Assistant Examiner*—Kevin P. Shaver

*Attorney, Agent, or Firm*—Beveridge, DeGrandi and Kline

[57] ABSTRACT

A handle assembly for a pressurized dispensing container consists of a handle 12 and a collar 11. The collar is fitted with legs 28, provided with bulbous portions 29 which clip resiliently into a groove 20 in the valve cup. The handle is provided with lugs 41 which engage with the collar. The handle is inserted into the collar and twisted to engage the lugs 41 with the collar to retain the handle. The lugs also press against legs 28 to prevent the collar becoming detached from the cam 13. A rachet surface 30 is provided around the top of the collar which is engaged by a tab on the handle as the handle is twisted to lock it into the collar. The rachet surface thus prevents the handle from being disengaged by being twisted in a direction opposite to that required for engaging the lugs.

11 Claims, 5 Drawing Figures

HANDLE ASSEMBLY FOR A PRESSURIZED DISPENSING CONTAINER

The invention relates to handle assemblies for pressurized dispensing containers, particularly such containers of the type in which the valve closing off the open end of the container includes a valve cup with a central recess and an inward-facing peripheral groove.

Such containers are often smooth-walled aluminium cans to which the valve is crimped. The groove is formed in the crimping operation as an enlarged diameter portion of the valve cup which engages the inside of the open end of the container to retain the valve in the end of the container. In the past, such containers have been used in such applications as fire extinguishers where it is necessary to provide a handle for the container.

Difficulties have been experienced in attaching handles to such containers satisfactorily and the present invention seeks to overcome or reduce these difficulties.

The invention provides a handle assembly for a pressurized dispensing container having a valve closing off an open end of the container and including a valve cup with an inward-facing peripheral groove, the handle assembly comprising a collar for fitting over the valve cup of a container to which the handle assembly is fitted in use, the collar including at least one resilient leg having a bulbous portion for engaging the peripheral groove and a handle, interengaging means being provided on the handle and the collar for attaching the handle to the collar, said interengaging means including means for engaging the or each leg of the collar when assembled whereby to prevent disengagement of the leg from the groove.

Preferably the interengaging means comprises an annular flange having cut-out portions provided on the collar and a boss provided on the handle and including projections corresponding in shape to the cut-out portions, the handle being engaged with the collar by inserting the boss through the flange with the projections passing through the cut-out portions and thereafter turning the handle relative to the collar so that the projections engage the underside of the flange.

The engaging means may comprise at least one cam surface of the boss which engages the leg as the handle is turned to positively lock the collar to the valve.

Alternatively the interengaging means may comprise at least one keying tongue on the collar, and a boss provided on the handle and including at least one lug corresponding to the keying tongue having a keying portion on the handle, the handle being engaged with the collar by inserting the boss into the collar so that the keying tongue passes the lug, and thereafter turning the handle relative to the collar so that the projections engage the underside of the flange.

Also the engaging means may comprise an engaging portion of the lug, and a corresponding cammed surface on the inside of the leg which is engaged by the engaging portion of the lug as the handle is turned to positively lock the collar to the valve.

The assembly may further comprise ratchet means formed on the handle and collar so that removal of the handle from the collar after assembly is prevented.

An actuator for the valve of the container may be engaged to open the valve by a trigger provided on the handle. The trigger may be hinged to the handle and a wedge may be provided for insertion between the trigger and the handle to prevent accidental operation of the trigger.

The invention also provides a pressurised dispensing container having such a handle assembly. The container may be a fire extinguisher.

A preferred embodiment of the invention will now be described, by way of example, with reference to the accompanying drawings, in which.

Figure 1:
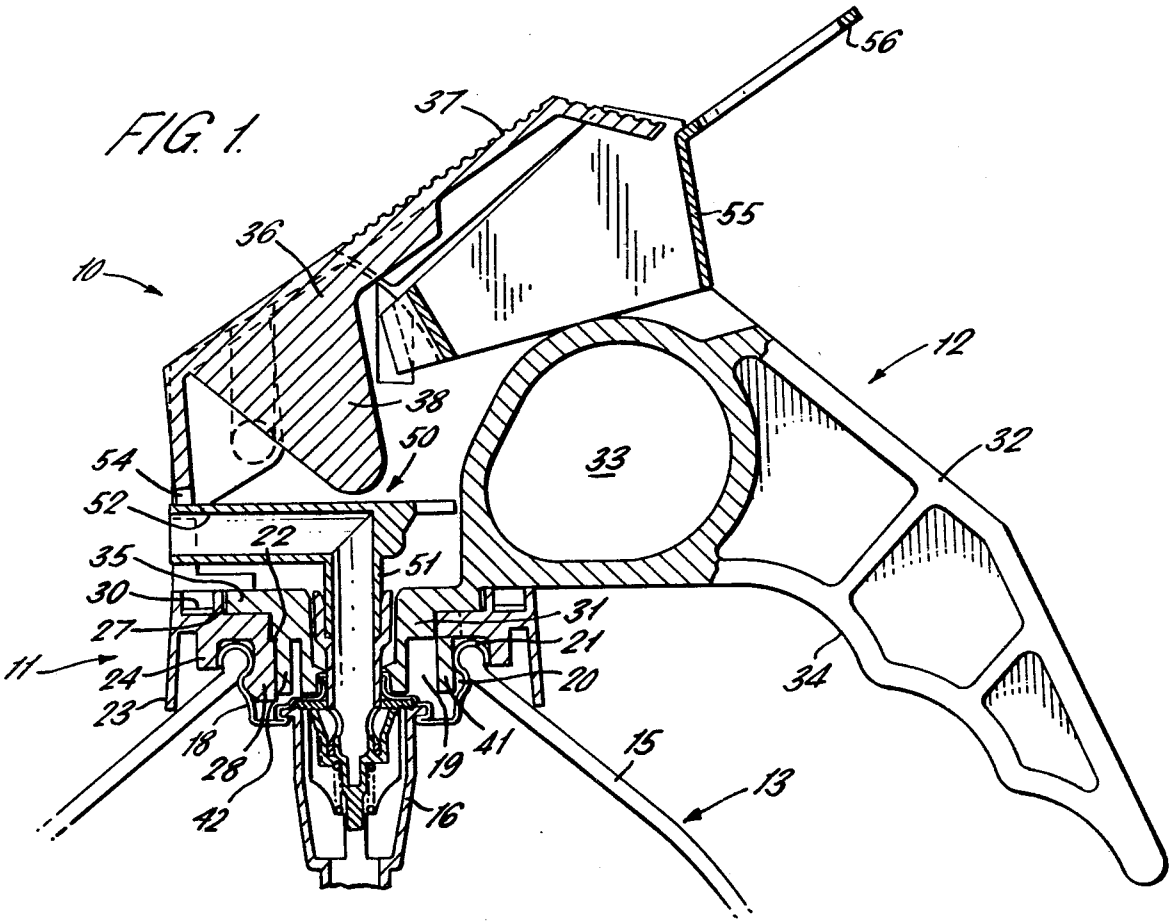
FIG. 1 is a section through a handle assembly according to the invention.
Figure 2:
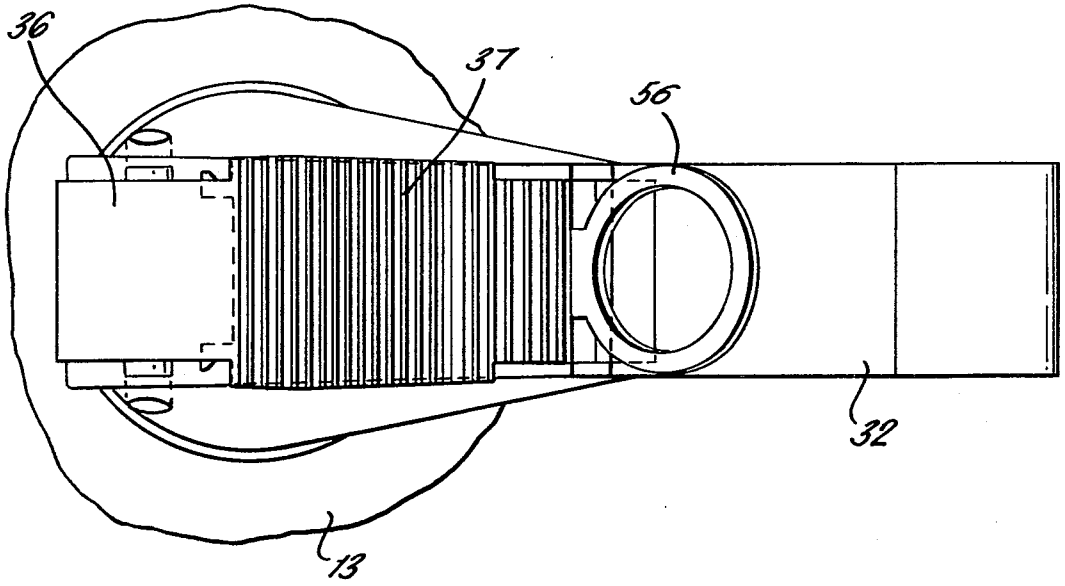
FIG. 2 is a plan view of the handle assembly.
Figure 3:
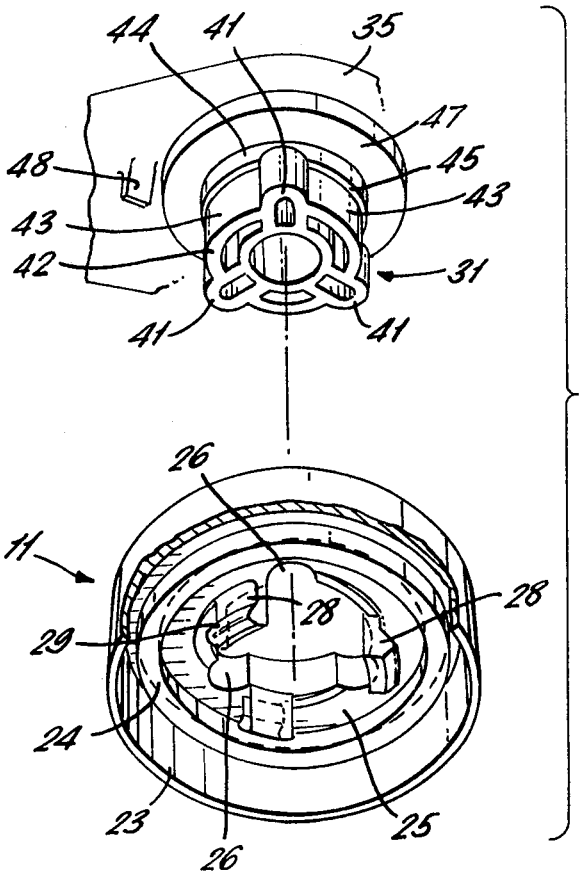
FIG. 3 is an exploded view of part of the handle assembly.

Referring to the drawings, of FIGS. 1 to 3, a handle assembly 10 has two main parts, a collar 11 and a handle 12. The handle assembly is particularly designed for fitting to a pressurized dispensing (aerosol) container 13 of the type illustrated in FIG. 1. The container 13 consists of a smooth-walled aluminium can 15 to which a valve 16 is attached to close off the open end of the can. The valve (which is of well known type) has a valve cup 18 with a central recess 19, the edge 21 of the valve cup being crimped to the neck of the can. The crimping-operation also forms an enlarged diameter portion of the cup which defines an inward facing peripheral groove 20. The enlarged diameter portion retains the valve in the end of the container 13 and ensures it is not forced out of the end of the can by the pressure inside the container. It will be appreciated from FIG. 1 that the frusto-conical shape of the neck of the can 15 means that that crimped edge 21 of the valve cup does not provide a satisfactory anchorage for a handle and this has proved a problem in the past particularly when heavy containers are used in applications such as fire extinguishers, when a handle is essential.

The collar 11 of the handle assembly is a generally cylindrical collar with an outer skirt 23, a central cylindrical portion 24 which is of a diameter to fit around the crimped edge 21 of the valve, and an inwardly-directed annular flange 25. The flange has three cut-out portions 26 which are best seen in FIG. 3 and adjacent to each cut-out portion, a depending leg 28 which is resilient and includes a bulbous portion 29 at its lower end and an upwardly facing surface 22 at its upper end.

The upper surface of the collar has a circular racket surface 30 between an upwardly extending portion of the skirt 23 and a cylindrical wall 27. As seen in FIG. 1, the collar 11 is snap-fit onto the container 13 so that the legs project into the recess 19 and the bulbous portions 29 resiliently engage the groove 20.

The handle 12 has a boss 31 projecting downwardly from a body portion 35 of the handle and extending rearwardly and downwardly from the body portion, a grip 32 which is shaped to be gripped by a user of the container. For this purpose the grip includes a hole 33 into which the forefinger is inserted, in use and a contoured lower surface 34 shaped to receive the other three fingers. Hinged to the handle 12 above the boss 31 is a trigger 36 which has a shaped and ribbed upper surface 37 and a depending activating flange 38. The trigger is hinged for operation by the thumb of a user gripping the handle as described above.

As best seen in FIG. 3, the boss 31 is a double-walled cylindrical boss having three arcuate lugs 41. The outer wall 42 of the boss 31 is of variable thickness between each pair of lugs 41 to provide three cam surfaces 43, each extending between two lugs. An enlarged diameter portion 44 of the boss above the lugs also has cam surfaces 45 formed on its downward facing surface. An annular flange 47 of the body portion is above the enlarged diameter portion 44 and spaced from the lugs 41 by approximately the thickness of the flange 25 of the collar. The body 35 also has a downwardly projecting panel 48.

The handle is attached to the collar (and the container) as follows. The boss 31 is inserted into the collar 11 so that the lugs 41 pass through the cut out portions 26, the cam surfaces 45 rest of the upwardly facing surfaces 22 and the flange 47 rests on the upper surface of the collar. The handle is then turned so that the lugs 41 engage the underside of the flange 25 to retain the handle in position. Simultaneously, the cam surfaces 45 engage the surfaces 22 to clamp the lugs against the underside of the flange 25 and the cam surfaces 43 engage the legs 28 to urge the legs outwardly so that the bulbous portions 29 remain firmly seated in the groove 20. Finally, the panel 48 engages the ratchet surface 30 so that, once the handle has been turned into position engaged with the collar, it cannot be turned in the opposite direction without damage to the handle and collar.

An actuator 50 for the valve 11 is located within the body of the handle 12. The actuator is of known type having a stem 51 which is inserted into the valve 16 as the handle is inserted into the collar and a head 52 including a nozzle which delivers the contents of the container through an aperture 54 in the handle. In use of the aerosol, depression of the trigger 36 causes the actuating flange 38 to engage the actuator 50 and thereby open the valve.

To prevent accidental or premature depression of the trigger, a safety device in the form of a wedge 55 is provided. The wedge fits between the trigger 36 and grip portion 32 of the handle and includes a ring 56 to facilitate removal of the wedge. The wedge may also include a tag (not shown) projecting through a hole in the handle which tag must be broken in order to remove the wedge. Such a tag serves as an indicator that the aerosol may have been used and this is important particularly when the aerosol is a fire extinguisher.

Figure 4:
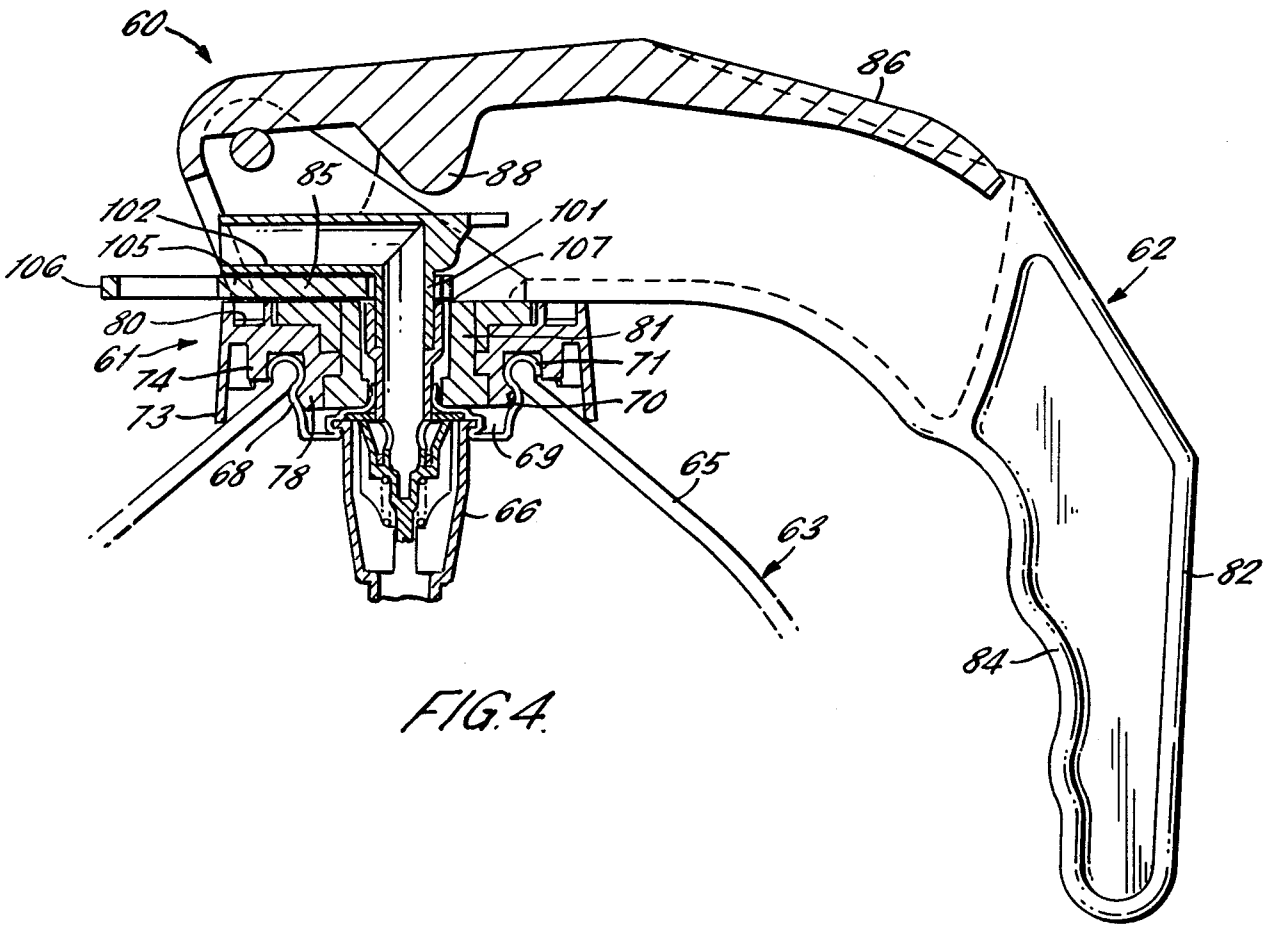
FIG. 4 is a section through a handle assembly of a alternative embodiment of the invention.
Figure 5:
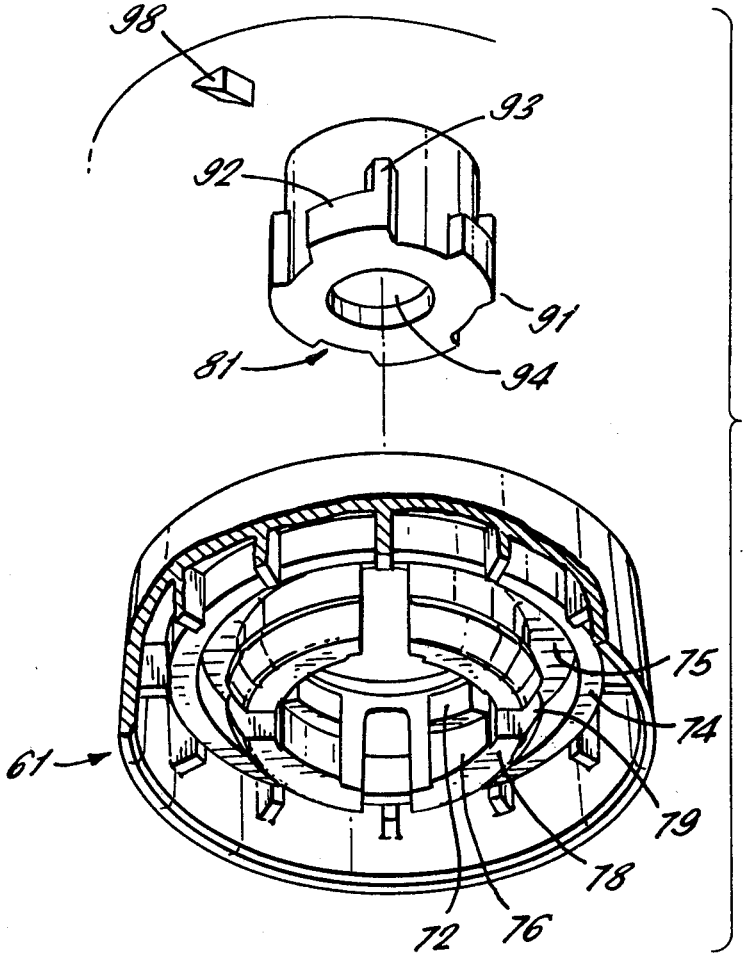
FIG. 5 is an exploded view of part of the handle of FIG. 4.

An alternative embodiment is shown in FIGS. 4 and 5. As before, the handle assembly 60 has two main parts, a collar 61 and a handle 62. The handle assembly is particularly designed for fitting to a pressurized dispensing container 63, which is similar to container 13 shown in FIG. 1. The container 63 consists of a smooth walled alluminum can 65 to which a valve 66 is attached.

The valve has a valve cup 68 with a central recess 69, the edge 71 of the valve cup being crimped to the neck of the can 63. As before, the crimping operation forms an enlarged diameter portion of the cup which defines on inward facing peripheral groove 70.

The collar 61 of the handle assembly is a generally cylindrical collar with an outer skirt 73, a central cylindrical portion 74 which is of a diameter to fit around the crimped edge 71 of the valve cup, and an inwardly directed annular flange 75. The flange 75 has four depending legs 78 which are resilient, and include a bulbous portion 79 of their lower ends. On the inside of each leg 78 is a keying tongue 72, below which is a cam surface 76.

As seen in FIG. 4, the collar 61 is a snap-fit onto the container 63 so that the legs project into the recess 69 and the bulbous portions 79 resiliently engage the groove 70.

The handle 62 has a boss 81 which projects downwardly from a body portion 85 of the handle. There is also a grip 82 which extends rearwardly and downwardly away from the boss. The grip 82 is shaped to be gripped by a user of the container, the lower surface fingers of the operators hand.

Hinged to the handle above the plug 81 is a trigger 86 which has a depending activating flange 88. The trigger is hinged for operation by the thumb of a user gripping the handle.

As shown in FIG. 5, the boss 81 is cylindrical, with an annular hole 94, and has four lugs 91. Each lug 91 consists of a keying portion 92 and an engaging portion 93.

The handle is attached to the collar as follows. The boss 81 is inserted into the collar 61 so that the lugs 91 pass between the keying tongues 72, and the body portion 85 of the handle rests on the upper surface of the collar. The handle is then turned so that the keying portion 92 of each lug engages the underside of a corresponding keying tongue 72, to lock the handle into the collar. The mating surfaces of keying portions 92 and the keying tongue 72 are all inclined so that the surfaces engage in a wedging action.

Simultaneously with the keying portions 92 and the keying tongues 72 engaging, the engaging portions 93 are forced by the rotation of the boss against the can surfaces 76. This forces bulbous portions 79 of the lugs 78 more firmly into the groove 70, and prevents the collar 61 from disengaging from the can 63. The greater width of the legs of this embodiment decreases the chance of the handle being accidentally broken off from the can.

Finally the panel 98 engages a rachet surface 80 on the topside of the collar 61 so that, once the handle has been turned into position and is engaged with the collar; it cannot be turned in the opposite direction without damage to the handle and collar.

To prevent accidental or premature depression of the trigger, a safety device in the form of a tab 105 is provided. The tab fits between the collar 61 and the nozzle 102 to prevent depression of the nozzle. The tab has at its outer end a ring 106 to facilitate removal of the tab. There is also a second ring 107 which surrounds the nozzle stem 101. This ring 107 is provided with a weakened section so that a hard pull on the ring 106 will cause ring 107 to break at the weakened section and enable the tab 105 to be removed.

We claim:

1. A handle assembly for a pressurized dispensing container having a valve closing off an open end of the end of the container and including a valve cup with an inward-facing peripheral groove, the handle assembly comprises a collar for fitting over the valve cup of a container to which the handle assembly is fitted in use, and a handle, includes the collar at least one resilient leg having a bulbous portion for engaging the peripheral groove, interengaging means being provided on the handle and the collar for attaching the handle to the collar, said interengaging means including means for engaging at least one leg of the collar when assembled whereby to prevent disengagement of the leg from the groove.

2. An assembly as claimed in claim 1 in which the interengaging means comprises an annular flange having cut-out portions provided on the collar and a boss provided on the handle and including projections corresponding in shape to the cut-out portions, the handle being engaged with the collar by inserting the boss through the flange with the projections passing through the cut-out portions and thereafter turning the handle relative to the collar so that the projections engage the underside of the flange.

3. An assembly as claimed in claim 2 in which the engaging means comprises at least one cam surface of the boss which engages the leg as the handle is turned.

4. An assembly as claimed in claim 1 in which the interengaging means comprises at least one keying tongue on the collar, and a boss provided on the handle and including at least one lug having a keying portion corresponding to the keying tongue on the collar, the handle being engaged with the collar by inserting the boss into the collar so that the lug passes the keying tongue, and thereafter turning the handle relative to the collar so that the keying portion engages the underside of the keying tongue.

5. An assembly as claimed in claim 4 in which the engaging means comprises an engaging portion of the lug, and a corresponding cammed surface on the inside of the leg which is engaged by the engaging portion of the lug as the handle is turned, to prevent disengagement of the leg from the valve.

6. An assembly as claimed in claim 1 further comprising ratchet means formed on the handle and collar so that removal of the handle from the collar after assembly is prevented.

7. An assembly as claimed in claim 1 further comprising an actuator for the valve of the container and in which the handle includes a trigger for engaging the actuator to open the valve.

8. An assembly as claimed in claim 7 in which the trigger is hinged to the handle.

9. An assembly as claimed in claim 7 further comprising a wedge for insertion between the trigger and the handle to prevent accidental operation of the trigger.

10. An assembly as claimed in claim 7 further comprising a tab for insertion between the actuator and the collar to prevent accidental operation of the trigger.

11. A pressurized dispensing container comprising a valve closing off an open end of the container and including a valve cup with an inward facing peripheral groove and a handle assembly as claimed in claim 1.

* * * * *